US007922208B2

(12) United States Patent
Haas et al.

(10) Patent No.: US 7,922,208 B2
(45) Date of Patent: Apr. 12, 2011

(54) METHOD AND SYSTEM FOR PROTECTING PRIVACY OF SIGNATURES ON MAIL BALLOTS

(75) Inventors: Bertrand Haas, New Haven, CT (US); Douglas B. Quine, Bethel, CT (US); Bradley R. Hammell, Fairfield, CT (US); Matthew J. Campagna, Ridgefield, CT (US)

(73) Assignee: Pitney Bowes Inc., Stamford, CT (US)

( * ) Notice: Subject to any disclaimer, the term of this patent is extended or adjusted under 35 U.S.C. 154(b) by 1098 days.

(21) Appl. No.: 11/636,800

(22) Filed: Dec. 11, 2006

(65) Prior Publication Data

US 2008/0136162 A1 Jun. 12, 2008

(51) Int. Cl.
*B42D 15/00* (2006.01)

(52) U.S. Cl. ..... 283/5; 283/72; 283/101; 283/116; 283/117

(58) Field of Classification Search ..... 283/72, 283/101, 116, 117, 5; 235/386; 229/68.1
See application file for complete search history.

(56) References Cited

U.S. PATENT DOCUMENTS

| | | | | |
|---|---|---|---|---|
| 2,386,933 | A * | 10/1945 | Cordell | 283/5 |
| 4,128,437 | A | 12/1978 | Ura et al. | |
| 4,237,185 | A | 12/1980 | Lombardi et al. | |
| 4,271,227 | A | 6/1981 | Muller et al. | |
| 4,416,950 | A | 11/1983 | Muller et al. | |
| 4,513,056 | A | 4/1985 | Vernois et al. | |
| 4,526,803 | A | 7/1985 | White | |
| 4,597,591 | A | 7/1986 | Gendron et al. | |
| 5,015,318 | A | 5/1991 | Smits et al. | |
| 5,207,871 | A | 5/1993 | Murphy et al. | |
| 5,288,994 | A | 2/1994 | Berson | |
| 5,294,470 | A | 3/1994 | Ewan | |
| 5,416,126 | A | 5/1995 | Murphy et al. | |
| 5,418,205 | A | 5/1995 | Mehta et al. | |
| 5,639,523 | A * | 6/1997 | Ellis | 428/34.2 |
| 5,811,792 | A | 9/1998 | Verschuur et al. | |
| 6,103,355 | A | 8/2000 | Mehta | |
| 6,143,120 | A | 11/2000 | Mehta et al. | |
| 6,447,015 | B1 | 9/2002 | Linnewiel | |
| 6,692,819 | B1 | 2/2004 | Castle et al. | |
| 6,902,770 | B1 | 6/2005 | Dulin et al. | |
| 7,240,835 | B2 | 7/2007 | Brucker et al. | |
| 7,641,116 | B2 * | 1/2010 | Haas et al. | 235/386 |
| 2005/0008836 | A1 | 1/2005 | Dulin et al. | |
| 2005/0061866 | A1 | 3/2005 | Ackley et al. | |
| 2007/0095908 | A1 | 5/2007 | Haas et al. | |
| 2008/0121680 | A1 | 5/2008 | Quine et al. | |
| 2008/0142594 | A1 | 6/2008 | Haas et al. | |
| 2008/0143096 | A1 | 6/2008 | Haas et al. | |
| 2008/0156862 | A1 | 7/2008 | Haas et al. | |

* cited by examiner

*Primary Examiner* — Dana Ross
*Assistant Examiner* — Justin V Lewis
(74) *Attorney, Agent, or Firm* — Brian A. Lemm; Charles R. Malandra, Jr.

(57) ABSTRACT

An envelope used in voting by mail includes a signature area on which the signature is affixed and a concealing portion structured to cover the signature area thereby concealing the signature. The concealing portion includes a concealing layer that is preferably positioned on top of a protective layer. The protective layer is positioned between the signature area and the concealing layer when the concealing portion covers the signature area. The concealing layer is formed from a material that is normally opaque but becomes at least partially transparent when one or more chemicals are applied to the concealing layer. The protective layer protects the signature from the one or more chemicals since the protective layer is impermeable to the one or more chemicals.

11 Claims, 3 Drawing Sheets

METHOD AND SYSTEM FOR PROTECTING PRIVACY OF SIGNATURES ON MAIL BALLOTS

FIELD OF THE INVENTION

The invention disclosed herein relates to voting systems, and more particularly to a method and system for protecting the privacy of signatures on ballots sent through the mail.

BACKGROUND INFORMATION

In democratic countries, governmental officials are chosen by the citizens in an election. Conducting an election and voting for candidates for public office in the United States can be performed in several different ways. One such way utilizes mechanical voting machines at predetermined polling places. When potential voters enter the predetermined polling place, voting personnel verify that each voter is properly registered in that voting district and that they have not already voted in that election. Thus, for a voter to cast his vote, he must go to the polling place at which he is registered, based on the voter's residence. Another method for conducting an election and voting utilizes paper ballots that are mailed to the voter who marks the ballot and returns the ballot through the mail. Mailed ballots have been historically reserved for absentee voting. In the usual absentee voting process, the voter marks the ballot to cast his/her vote and then inserts the ballot in a return envelope which is typically pre-addressed to the voter registrar office in the corresponding county, town or locality in which the voter is registered. The voter typically appends his/her signature on the back of the envelope adjacent his/her human or machine readable identification.

When the return envelope is received at the registrar's office, a voting official compares the voter signature on the envelope with the voter signature retrieved from the registration file to make a determination as to whether or not the identification information and signature are authentic and valid, and therefore the vote included in the envelope should be counted. If the identification information and signature are deemed to be authentic and valid, the identifying information and signature are separated from the sealed ballot before it is handed to the ballot counters for tabulation. In this manner, the privacy of the voter's selections is maintained and thus the ballot remains a "secret ballot."One general problem with vote by mail envelopes is the signature is in the open and exposed for all to see throughout the process for determining whether or not the vote is authentic. This leads to potential privacy issues and concerns, e.g., fraudulent usage of a voter's signature. Some jurisdictions have required that such signatures be hidden from plain sight while the envelope is en route from the voter to the registrar's office. This will protect against easy imaging of the signature, such as, for example, with a hand scanner or digital camera, for later impersonation or other fraudulent purposes, e.g., identity theft. To comply with such requirements, envelopes have been proposed that hide the signature with a flap which is removed when the envelope is received at the registrar's office. These solutions, however, require some mechanical manipulation of the envelopes, which is both expensive and increases the risk of accidental tears of the envelope, potentially leading to damage to the ballots contained in the envelopes, exposing the marked ballot before the conclusion of the authentication process (which in some states require the ballot to be counted, regardless of the outcome of the authentication process), or the ability to link the voter with his/her ballot, thereby removing the secret ballot.

Voting by mail is becoming more prevalent, apart from the usual absentee voting, and in some jurisdictions, entire elections are being conducted exclusively by mail. Thus, there exists a need for efficient methods and systems that can protect the privacy of signatures on ballots sent through the mail while also reducing the risk of damage to the ballots when the signatures are revealed.

SUMMARY OF THE INVENTION

The present invention is directed to an envelope for carrying a signature of an individual including an area on which the signature is affixed and a concealing portion. The concealing portion is structured to cover the signature area thereby concealing the signature. The concealing portion includes a concealing layer that is preferably positioned on top of a protective layer. The protective layer is positioned between the signature area and the concealing layer when the concealing portion covers the signature area. The concealing layer is made of a material that is normally opaque but becomes at least partially transparent when one or more chemicals are applied to the material. The protective layer, which is at least partially transparent, protects the signature from the one or more chemicals since the protective layer is impermeable to the one or more chemicals.

In accordance with yet another embodiment of the invention, a method for processing a signature of an individual is provided that includes receiving an envelope that includes a signature area on which the signature is affixed and a concealing portion. The concealing portion is structured to cover the signature area thereby concealing the signature. The concealing portion includes a concealing layer that is preferably positioned on top of a protective layer. The protective layer is positioned between the signature area and the concealing layer when the concealing portion covers the signature area. The concealing layer is made of a material that is normally opaque but becomes at least partially transparent when one or more chemicals are applied to the material. The protective layer, which is at least partially transparent, protects the signature from the one or more chemicals since the protective layer is impermeable to the one or more chemicals. The method further includes applying the one or more chemicals to the concealing portion to cause the concealing layer to become at least partially transparent, and reading the signature through the concealing portion while the concealing layer is transparent.

In still another embodiment, the invention provides a method of voting that includes providing a ballot inside an envelope having a main body and a flap, wherein the main body includes a signature area, and wherein the flap includes a concealing portion structured to selectively cover the signature area. The concealing portion includes a concealing layer preferably provided on top of a protective layer, wherein the protective layer is positioned between the signature area and the concealing layer when the concealing portion covers the signature area. The concealing layer is made of a material that is normally opaque and that becomes at least partially transparent when one or more chemicals are applied to the material. The protective layer is at least partially transparent and is substantially impermeable to the one or more chemicals. The method further includes writing a signature on the signature area, folding the flap over the main body into a position wherein the concealing portion covers the signature area and conceals the signature, and mailing the envelope to a voting authority.

Therefore, it should now be apparent that the invention substantially achieves all the above aspects and advantages.

Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

Figure 1:
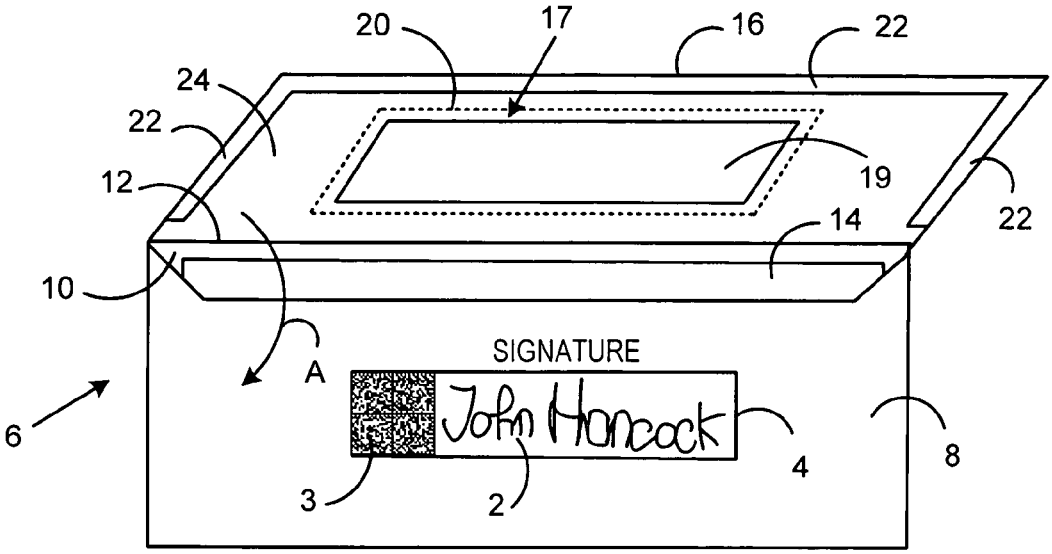
FIG. 1 is a back elevational view of an improved return envelope in accordance with an embodiment of the present invention.

As used herein, the phrase "a number of" or variations thereof mean one or an integer greater than one. Directional phrases used herein, such as, for example, upper, lower, left, right, vertical, horizontal, top, bottom, above, beneath, clockwise, counterclockwise and derivatives thereof, relate to the orientation of the elements shown in the drawings and are not limiting upon the claims unless expressly recited therein.

As noted elsewhere herein, use of vote-by-mail return envelopes wherein a voter has affixed his or her signature to the envelope raises a number of privacy issues and the possibility of identity theft. This invention overcomes this shortcoming by providing an improved return envelope that is able to conceal the signature of the voter while allowing a voting official and/or machine to view the signature by applying a transparentization chemical onto the envelope.

FIG. 1 shows an envelope 6 according to a first embodiment of the present invention wherein a voter has affixed (i.e., written) his signature 2 to a signature area 4 that is provided on the body portion 8 of the envelope 6. In order to increase the contrast between the signature 2 and the signature area 4, the signature area 4 is preferably enhanced, such as with a chemical or paper coating, in a manner which optimizes its reflectivity. A two dimensional bar code 3 which may be, for example, a Datamatrix Symbol, and which, in the preferred embodiment, includes identifying information for the voter, may be positioned adjacent to the signature area 4. Alternatively, the bar code 3 may be located anywhere on the envelope 6 where it can be read without any special manipulation of the envelope 6. The bar code 3 can also optionally be encrypted to protect the data contained therein. The pocket of the envelope 6 can be accessed through an opening 10 that is positioned adjacent the top end 12 of the envelope 6. As can be seen from FIG. 1, a ballot 14, which includes the voter's votes, has been inserted into the pocket of the envelope 6 via this opening 10 for subsequent transport by mail to an appropriate voting authority. The envelope 6 further includes a flap 16 having an edge that is pivotably connected to the top end 12 of the envelope 6. The flap 16 also includes a concealing portion 17 that covers the signature area 4 when the flap 16 is pivoted towards the body portion 8 of the envelope 6 in the direction of arrow A.

Figure 2:
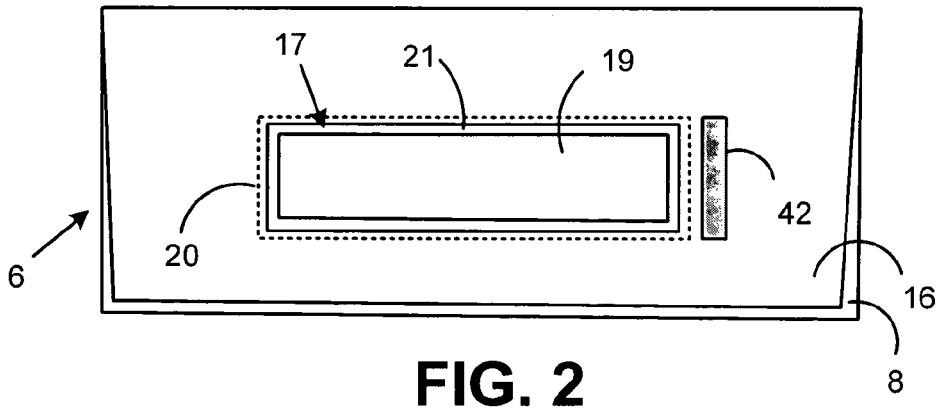
FIG. 2 is a back elevational view of the improved return envelope of FIG. 1 prior to application of a transparentizing chemical to the flap of the envelope.
Figure 3:
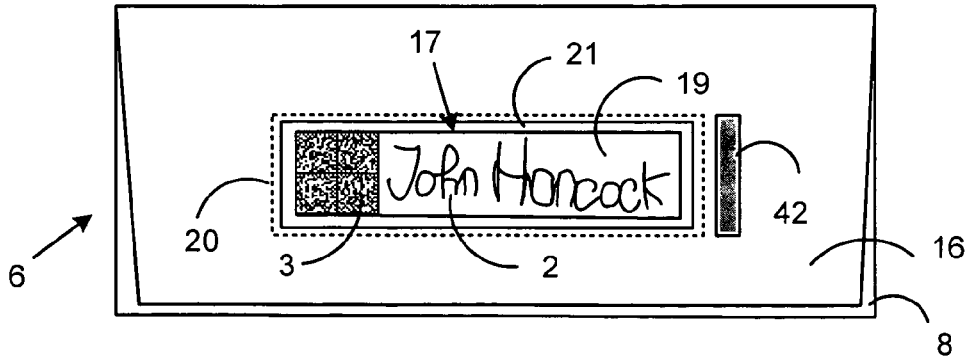
FIG. 3 is a back elevational view of the improved return envelope of FIG. 1 after the application of a transparentizing chemical to the flap of the envelope.

The concealing portion 17 includes a concealing layer 19 that, under normal conditions, is opaque. Thus, when the flap 16 of the envelope 6 is closed as seen in FIG. 2, the concealing layer 19 covers the signature area 4 and conceals the signature 2 and, preferably, the bar code 3. Furthermore, the concealing layer 19 is made of a material, preferably a paper material, that becomes at least partially transparent when a specific one or more chemicals (referred to as "transparentizing chemicals") are applied to the material. As a result, the signature 2 and bar code 3, if present, become, at least temporarily, viewable through the concealing portion 17 as shown in FIG. 3. Such material and corresponding chemicals are well known in the art and are described in, for example, U.S. Pat. Nos. 6,103,355; 6,143,120; and 6,692,819, each of which are incorporated in their entirety by reference herein. As will be appreciated, the specific type of transparentizing chemical that can be applied to the material forming the concealing layer 19 in order to make the material transparent is dependent upon the type of material from which the concealing layer 19 is manufactured. Additionally, the concealing layer 19 may be chemically enhanced to facilitate its impregnation with the transparentizing chemical. For example, if the transparentizing chemical is an aqueous solution, then the concealing layer 19 can be enhanced with a number of hydrophilic chemicals to facilitate the affinity of the concealing layer 19 to the transparentizing chemical.

Additionally, in one particular embodiment, a number of pre-cut lines (perforations) 20 are disposed along the perimeter of the concealing portion 17 in the flap 16. The pre-cut lines (perforations) 20 allows for a voting official and/or machine to remove the concealing portion 17 thereby exposing the signature area 4 that was covered by the concealing portion 17 without having to open the envelope 6. The flap 16 also includes a number of sealing strips 22, which are disposed along a surface 24 of the flap 16, for sealing the flap 16 to the body portion 8 of the envelope 6.

One drawback with utilizing transparentizing chemicals on an envelope, such as an envelope 6, on which a signature, such as a signature 2, is affixed is that the transparentizing chemical, if it is allowed to come into contact with the signature, may react with the ink of the signature and cause the signature to deteriorate, thereby rendering the signature unreadable, it may come into contact with the contents of the envelope 6, e.g., ballot 14, thereby damaging the contents of the envelope 6, or may make portions of the envelope 6 transparent, thereby revealing the contents of the envelope 6. To overcome these shortcomings, in one embodiment a protective window 18 is preferably provided under the concealing layer 19. The protective window 18 is preferably manufactured from a partially transparent or transparent polymer material (e.g., plastic), that is impermeable to the particular transparentizing chemical or chemicals being used. Accordingly, when the transparentizing chemical is applied onto the concealing layer 19, the signature 2, which is covered by the protective window 18, is protected from the transparentizing chemical. Moreover, in order to further ensure that the signature 2 is protected from the transparentizing chemical that will be applied to the concealing layer 19, the flap 16 as well as the envelope 6 can be manufactured from a material that is impermeable to the transparentizing chemical as well.

Figure 4:
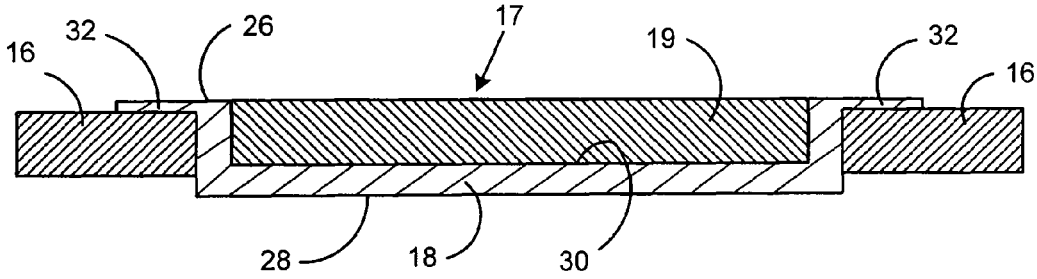
FIG. 4 is a cross-section of an embodiment of the concealing portion forming part of the improved return envelope of FIG. 1.

FIG. 4 is a cross-sectional diagram of one particular embodiment of a concealing portion 17, that includes a protective window 18, that can be disposed in the flap 16 of the envelope 6. As can be seen from this figure, the protective window 18 has a U-shape that includes a first side 26, a second side 28, a recess 30 that is disposed on the first side 26, and an outer flange 32 which extends around the perimeter of the protective window 18 for securing the protective window 18 to the flap 16 of the envelope 6 within a hole provided therein. In this particular embodiment, the protective window 18 is secured to the flap 16 of the envelope 6 by an adhesive that is disposed between the flange 32 of the protective window 18 and the flap 16 of the envelope 6. As seen in FIG. 4, the recess 30 receives and holds the concealing layer 19. In addition, the flange 32 may perform the function of the polymer material 21 described below. Additionally, in one particular embodiment, an adhesive is applied to the second side 28 of the protective window 18 so that the second side 28 of the protective window 18 may stick to the signature area 4 thereby avoiding a deterioration of the visibility of the signature due to an inhomogenous layer of air between the signature area 4 and the protective window 18. In an alternative embodiment, if the signature area 4 is formed from a material that is impermeable to the transparentizing chemical, an adhesive can be applied around the signature area 4 such that the protective window 18 will adhere to the adhesive when the flap 16 is closed, thereby sealing the signature 2 affixed to the signature area 4 in a chemically protected chamber.

In another embodiment, the concealing layer 19 can be formed from an impermeable partially transparent or transparent material that includes a "frosted" layer on top which renders the concealing layer 19 opaque. When a transparentizing chemical, which may be, for example, as simple as water, is added to the frosted layer, the frosted layer is rendered transparent, thereby allowing the signature 2 to become viewable through the concealing layer 19. One example of such a concealing layer 19 is a frosted polymer or glass, which is not transparent until drops of water are added to smooth out the rough surface so light passes through easily.

In another embodiment, a polymer material 21 (FIGS. 2 and 3) is disposed along the outer perimeter of the concealing layer 17 as shown in FIGS. 2 and 3, or the protective window 18, if provided, to prevent the possible contamination of the signature 2 by the transparentizing chemical via capillarity of the transparentizing chemical though the flap 16. The polymer material 21 can, for example, be infused or injected into the flap 16 around the concealing layer 17 or protective window 18, to prevent the lateral spread of the tranparentizing chemical along the flap 16 and onto to the body portion 8, where it may contaminate the signature 2.

A variety of systems may be implemented to view the signatures of envelopes 6 including ballots 14 therein that are received at the office of a voting authority in order to authenticate the signatures on the envelopes 6. One such system is depicted schematically in FIG. 5. This figure schematically depicts an envelope 6 in a variety of stages as the envelope 6 passes through an automated apparatus 50 that is designed to not only apply the transparentizing chemical onto the concealing layer 19 but to also allow a voting official to view the signature 2 that is concealed under the concealing layer 19 and the protective window 18. Continuing with FIG. 5, apparatus 50 includes a control unit 52, such as, for example, one or more general or special purpose microprocessors, that control operation of the apparatus 50. An envelope 6 is first positioned onto a transport mechanism (not shown) such as, without limitation, a conveyor belt, that is moving in the direction of arrow B. Positioned along the length of the transport mechanism are a number of stations that include a detection station 36, a chemical spraying station 38, and an image capture station 40, that are coupled to the control unit 52.

Once positioned on the transport mechanism, the first station the envelope 6 will encounter is the detection station 36. As the envelope 6 passes under the detection station 36, the detection station 36, which may be, for example, a scanner or the like, scans the envelope 6 for a first indicator mark 42 which is positioned adjacent an end of the concealing portion 17 (see FIGS. 2 and 3). Upon detecting the first indicator mark 42, which can be, for example, a bar code, the control unit 52 will activate the spraying station 38, which can be, for example, an ink jet printing device having an array of nozzles or the like supplied by a reservoir, in order to apply the appropriate transparentizing chemical or chemicals to the concealing layer 19 of the concealing portion 17 of the envelope 6. After a set amount of time or upon detecting a second indicator mark (not shown), which can be positioned adjacent the opposite end of the concealing portion 17 from the first indicator mark 42, the spraying station 38 will stop spraying the transparentizing chemical or chemicals. As described elsewhere herein, the transparentizing chemical or chemicals will cause the concealing layer 19 to become, preferably temporarily, at least partially transparent. From the spraying station 38, the envelope 6 will then travel under the image capture station 40. The image capture station 40, which preferably includes a scanner, camera or the like, is adapted to capture an image of the signature 2 (through the now transparent concealing portion 17). The control unit 52 can then either transmit the image to a viewing station 44, which preferably includes a monitor, so that the signature 2 that is affixed on the signature pad 4 of the envelope 6 may be viewed remotely by, for example, a voting official, or alternatively can store the captured image in a database 54 for later retrieval and viewing. Preferably, the concealing layer 19 is completely transparent upon reaching the image capture station 40 so that the signature 2 may be inspected immediately. After the signature 2 has been captured, the envelope 6 is transported downstream for further processing as the concealing layer 19 begins to dry. In the preferred embodiment, once the concealing layer 19 dries it becomes opaque once again so that the signature 2 that is affixed on the signature area 4 can no longer be viewed. Accordingly, the identity of the individual that mailed the envelope 6 remains anonymous during any downstream processing that may be performed.

Figure 6:
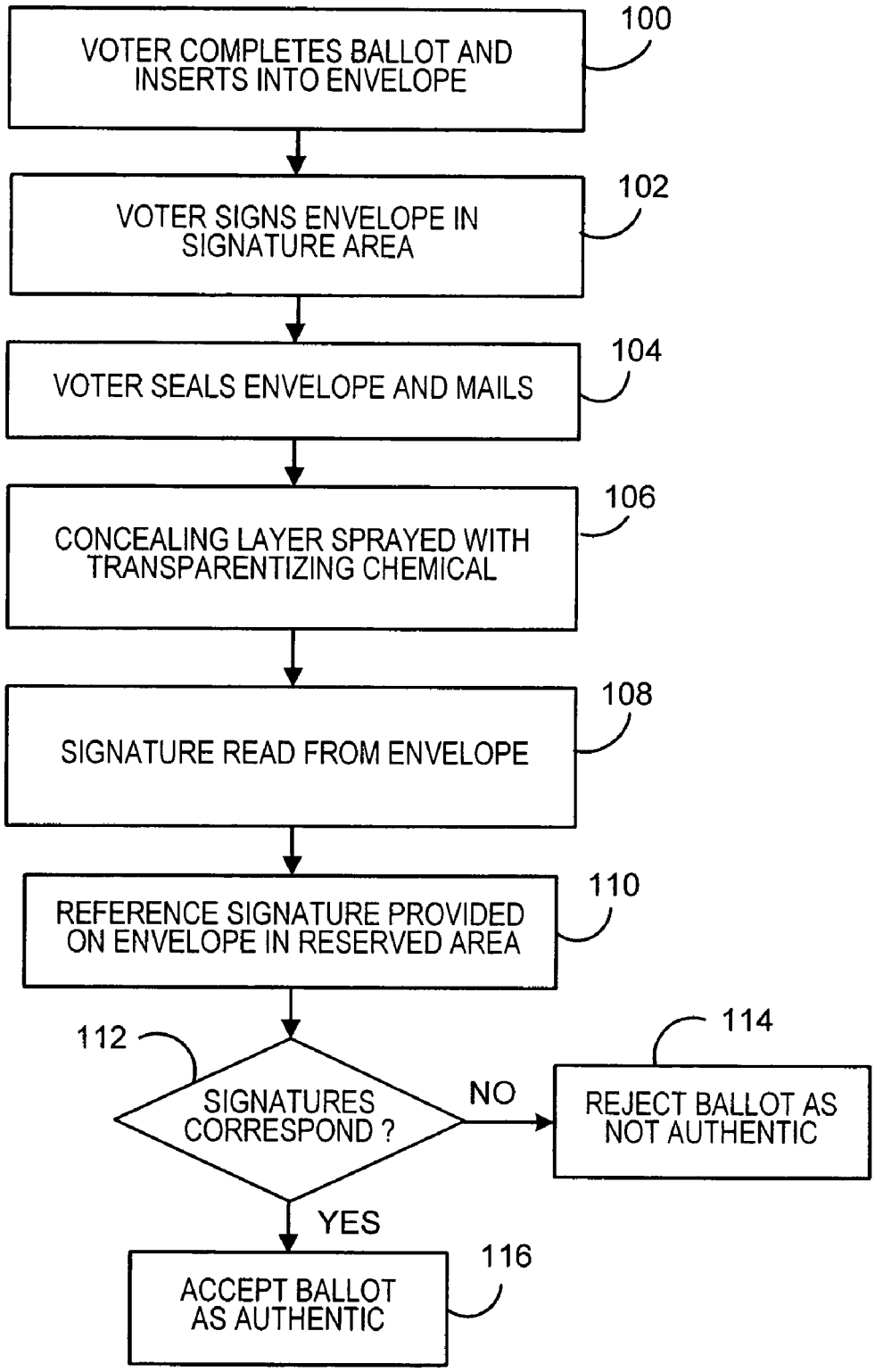
FIG. 6 illustrates in flow diagram form the preparation and processing of the improved return envelope of FIG. 1.

FIG. 6 illustrates in flow diagram form an embodiment of the preparation and processing of an envelope 6. In step 100, a voter completes a ballot and inserts it into the envelope 6. In step 102, the voter signs the envelope 6 in the signature area 4. In step 104, the voter seals the flap 16 to the body portion 8 of the envelope 6, thereby covering the signature area 4 with the concealing portion 17, and mails the envelope 6 to the registrar's office. The concealing portion 17 will conceal the voter's signature in the signature area 4, as described above with respect to FIG. 2. Thus, the privacy of the voter's signature is maintained during transit of the envelope 6 from the voter to the registrar's office.

Figure 5:
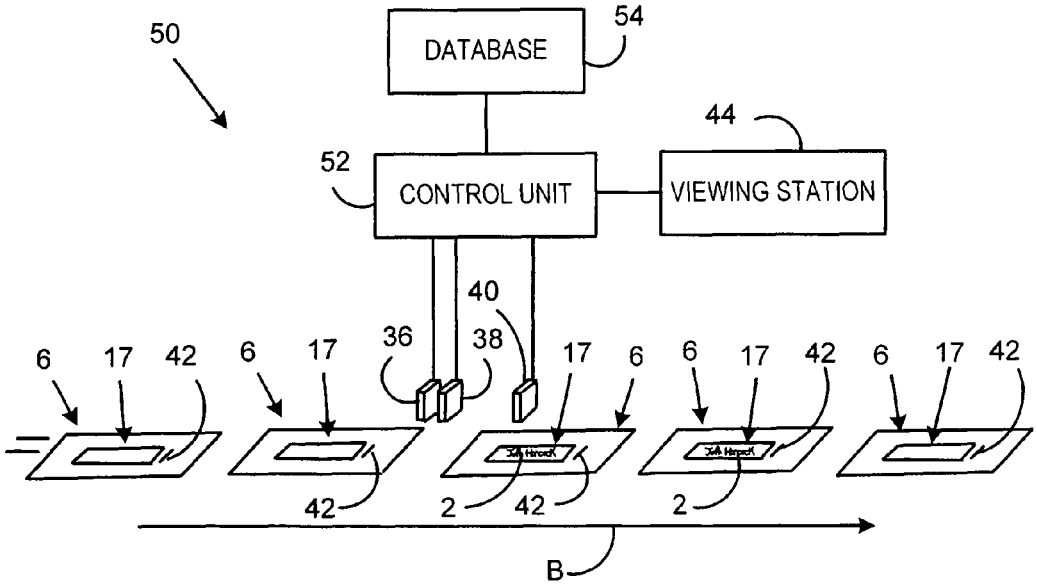
FIG. 5 is a schematic of an apparatus that can be utilized to view the signature that is affixed on the improved envelope of FIG. 1.

Upon receipt of the envelope 6 at the registrar's office, the envelope 6 can be processed using the system illustrated in FIG. 5. In step 106, the envelope 6 is transported by the transport and the spraying station 38 applies the appropriate transparentizing chemical or chemicals to the concealing layer 19, resulting in the concealing layer 19 becoming at least partially transparent as described above with respect to FIG. 3. The image capture station 40 can then capture an image of the signature in step 108. In step 110, the control unit 52 can retrieve the reference signature from the database 54 (based on the identification information included on the envelope 6 for the voter) and a comparison of the reference signature to the signature read from signature area 4 of envelope 6 can be performed. In step 112, it is determined if the reference signature retrieved from the database 54 corresponds to the signature read from signature area 4 of envelope 6. If the signatures do not correspond, then in step 114 the ballot is rejected as not being authentic. Rejected envelopes may be subject to some type of inspection to make a final determination if the vote should be counted or not. If in step 112 it is determined that the signatures do correspond, then in step 116 the ballot is deemed to be authentic and accepted, and the ballot can be given to ballot counters for tabulation.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An envelope comprising:

a body portion, said body portion forming a pocket having an opening for inserting material into said pocket, said body portion further having a signature area formed of a material that is substantially impermeable to one or more chemicals; and a flap portion connected to said body portion, said flap portion closing said opening when in a closed position, said flap portion including a concealing portion positioned to cover said signature area when said flap portion is in said closed position, fully enclosing said pocket said concealing portion including a concealing layer made of a material that is normally opaque and that becomes at least partially transparent when said one or more chemicals are applied to said material.

2. The envelope according to claim 1, wherein said concealing portion further comprises:

a protective layer having a first surface and a second surface opposite said first surface, said concealing layer being provided on adjacent to said first surface of said protective layer such that said protective layer is positioned between said signature area and said concealing layer when said concealing portion covers said signature area, said protective layer being at least partially transparent and being substantially impermeable to said one or more chemicals to protect said signature area from said one or more chemicals.

3. The envelope according to claim 2, wherein said protective layer is made of a polymer material.

4. The envelope according to claim 1, further comprising:

an adhesive disposed on said second surface of said protective layer, wherein said adhesive causes said second surface of said protective layer to adhere to said signature area when said concealing portion covers said signature area.

5. The envelope according to claim 1, further comprising a containment strip positioned around an outer perimeter of said concealing portion, said containment strip being substantially impermeable to said one or more chemicals.

6. The envelope according to claim 5, wherein said containment strip is made of a polymer material.

7. The envelope according to claim 1, further comprising a plurality of perforations provided in said flap around an outer perimeter of said concealing portion to allow said concealing portion to be selectively removed from said flap.

8. The envelope according to claim 1, wherein said concealing layer is formed of paper.

9. The envelope according to claim 1, wherein said signature area includes an applied coating to enhance reflectivity of said signature area.

10. The envelope according to claim 1, further comprising:

an adhesive disposed around said signature area.

11. The envelope according to claim 1, wherein said envelope is for transporting a ballot.

* * * * *